US009631454B1

(12) United States Patent
Sun et al.

(10) Patent No.: US 9,631,454 B1
(45) Date of Patent: Apr. 25, 2017

(54) WELLBORE PRESSURE CONTROL SYSTEM AND METHOD FOR OFFSHORE WELL CEMENTATION STAGES

(71) Applicant: China University of Petroleum (East China), Qingdao, Shandong (CN)

(72) Inventors: Baojiang Sun, Shandong (CN); Xuerui Wang, Shandong (CN); Yingwen Ma, Shandong (CN); Yonghai Gao, Shandong (CN)

(73) Assignee: China University of Petroleum (East China), Shandong (CN)

( * ) Notice: Subject to any disclaimer, the term of this patent is extended or adjusted under 35 U.S.C. 154(b) by 0 days.

(21) Appl. No.: 15/292,992

(22) Filed: Oct. 13, 2016

(30) Foreign Application Priority Data

Sep. 7, 2016 (CN) ..... 2016 1 0806790

(51) Int. Cl.
*E21B 33/14* (2006.01)
*E21B 43/12* (2006.01)
*E21B 33/12* (2006.01)

(52) U.S. Cl.
CPC ..... *E21B 33/146* (2013.01); *E21B 33/12* (2013.01); *E21B 43/12* (2013.01)

(58) Field of Classification Search
CPC ..... E21B 33/12; E21B 33/14; E21B 33/143; E21B 33/146; E21B 43/12
See application file for complete search history.

(56) References Cited

U.S. PATENT DOCUMENTS

| | | | | |
|---|---|---|---|---|
| 4,260,017 | A * | 4/1981 | Nelson | E21B 34/14 166/154 |
| 4,479,545 | A * | 10/1984 | Eley | E21B 34/14 166/154 |
| 8,322,460 | B2 * | 12/2012 | Horton, III | E21B 21/08 166/347 |
| 8,727,026 | B2 * | 5/2014 | Caldwell | E21B 33/146 166/289 |
| 8,800,655 | B1 * | 8/2014 | Bailey | E21B 33/146 166/177.4 |
| 9,249,646 | B2 * | 2/2016 | Hannegan | E21B 47/0005 |
| 9,328,575 | B2 * | 5/2016 | Feasey | E21B 7/12 |
| 2007/0068703 | A1 * | 3/2007 | Tessari | E21B 7/20 175/57 |
| 2008/0135248 | A1 * | 6/2008 | Talley | E21B 34/14 166/285 |

* cited by examiner

*Primary Examiner* — Matthew R Buck
(74) *Attorney, Agent, or Firm* — Calfee, Halter & Griswold LLP

(57) ABSTRACT

The present invention provides wellbore pressure control system and method for well cementation stages, and relates to the offshore oil and gas exploitation field. The wellbore pressure control system comprises: an injection pump; and a control device, configured to control the injection pump to inject a fluid or gas through an injection pipeline to a return pipeline that communicates with an annular space of the wellbore to decrease the pressure in the return pipeline and thereby decrease the pressure in the annular space, wherein, the density of the fluid or gas is lower than the density of a drilling fluid in the annular space. The technical scheme of the present invention can effectively prevent leaky zones from being fractured by high-density cement slurry in the well cementation process that may cause safety accidents such as well kick and well blowout, etc.

11 Claims, 6 Drawing Sheets

WELLBORE PRESSURE CONTROL SYSTEM AND METHOD FOR OFFSHORE WELL CEMENTATION STAGES

CROSS REFERENCE TO RELATED APPLICATIONS

This application claims priority to Chinese Application No. 201610806790.1, filed on Sep. 7, 2016, entitled "Well Bore Pressure Control System and Method for Offshore Well Cementation Stages", which is specifically and entirely incorporated by reference.

FIELD OF THE INVENTION

The present invention relates to the offshore oil and gas exploitation field, and particularly relates to a wellbore pressure control system and a wellbore pressure control method for well cementation stages.

BACKGROUND OF THE INVENTION

Deep sea areas are abundant in oil and gas resources, and it is an irresistible trend to further exploit and utilize the oil and gas resources in the deep sea areas. Deep water well cementation is an indispensable step in the oil and gas development process in the deep sea areas, but the difficulties brought by deep water has posed a serious challenge to deep water well cementation technology. Owing to the fact that certain part of the overlying rock formation in a deep water area is replaced by sea water, the pressure on the overlying rock formation is lower than that on land, and the formation tend to have relatively low fracture pressure under such low pressure on the overlying rock formation; in addition, in a deep water environment, the sedimentation rate is high, and abnormal pore pressures are developed widely, making the window of pore pressure and fracture pressure gradient narrower. For deep water formation with a narrow safety density window, applying the traditional well cementation method can let the high-density cement slurry fracture the formation that further cause safety accidents such as well kick and well blowout, etc. In view of that problem, many new techniques, such as two-stage well cementation, and foamed cement slurry system, etc., have been recently developed, and those techniques are able to solve the well cementation problem in short-section leaky zones. However, during deep-water well drilling, challenges from long-section leaky zones and multi-layer leaky zones, etc., are often encountered, and can't be successfully overcome with the above-mentioned well cementation techniques. Usually, to overcome such challenges, three stages, four stages or even more stages of well cementation are required; consequently, the well drilling difficulty is highly increased, and the drilling efficiency is severely decreased.

SUMMARY OF THE INVENTION

The object of the present invention is to provide a wellbore pressure control system and a wellbore pressure control method for well cementation stages, which can effectively prevent the formation from being fractured by high-density cement slurry and thereby avoid safety accidents such as well kick and well blowout, etc.

To attain the above-mentioned object, in an embodiment of the present invention, a wellbore pressure control system for well cementation stages is provided, comprising: an injection pump; and a control device, configured to control the injection pump to inject a fluid or a gas through an injection pipeline to a return pipeline that communicates with an annular space in a wellbore to decrease a pressure in the return pipeline and thereby decrease a pressure in the annular space, wherein, a density of the fluid or the gas is lower than a density of a drilling fluid in the annular space.

Optionally, the control device is further configured to execute the following operations: a) acquiring an amount of circulating flow in the annular space and a depth of the surface level of cement slurry in the annular space; b) calculating a pressure profile of the annular space according to the amount of circulating flow and the depth of the surface level of cement slurry; c) determining a discharge capacity of the injection pump, so that a pressure at any depth in the pressure profile of the annular space is between a fracture pressure of formation and a pore pressure of formation; and d) controlling the injection pump to inject the fluid or the gas according to the determined discharge capacity.

Optionally, the control device executes the steps a)-d) repeatedly, till that the surface level of cement slurry reaches to an external casing packer that is located in the annular space and on an upper part of a leaky zone.

Optionally, the control device is further configured to open the external casing packer to isolate the leaky zone, after the surface level of the cement slurry reaches to the external casing packer.

Optionally, the system further comprises a stage collar configured to make communication between a casing and the annular space above the external casing packer so that the cement slurry is injected into the annular space above the external casing packer, after the external casing packer isolates the leaky zone.

Optionally, the stage collar comprises: a main body, with outer stage holes on both sides respectively; a stage mechanism; and a closing sleeve, with inner stage holes on both sides respectively, wherein, when the stage collar is in a first state, it is shielded by the stage mechanism, so that the outer stage holes on both sides of the main body and the inner stage holes at both sides of the closing sleeve do not communicate with each other; when the stage collar is in a second state, the stage mechanism is displaced, so that the outer stage holes on both sides of the main body and the inner stage holes on both sides of the closing sleeve communicate with each other; when the stage collar is in a third state, the closing sleeve is displaced, the outer stage holes are staggered from the inner stage holes, and the outer stage holes on both sides of the main body are shielded by the closing sleeve.

Optionally, the stage collar further comprises: a shear pin, via which the stage mechanism is fixedly connected to the main body when the stage collar is in the first state; and a positioning key, located at the lower end of the main body, wherein, after the shear pin is sheared off, the stage mechanism moves downwards, till that a lower end of the stage mechanism is seated on the positioning key.

Optionally, the stage collar further comprises: an unlocking mechanism, via which the main body is fixedly connected to the closing sleeve when the stage collar is in the first state or the second state, wherein, after the unlocking mechanism is unlocked, the closing sleeve moves downwards, till that the closing sleeve is seated on the stage mechanism, and, at this point, the stage collar is in the third state.

Accordingly, in an embodiment of the present invention, a wellbore pressure control method for well cementation stages is provided, comprising the following procedure: controlling an injection pump to inject a fluid or a gas through an injection pipeline to a return pipeline that communicates with an annular space in a wellbore to decrease a pressure in the return pipeline and thereby decrease a pressure in the annular space, wherein, a density of the fluid or the gas is lower than a density of a drilling fluid in the annular space.

Optionally, the step of controlling the injection pump to inject the fluid or the gas through the injection pipeline to the return pipeline that communicates with the annular space of the wellbore comprises the following steps: a) acquiring an amount of circulating flow in the annular space and a depth of the surface level of cement slurry in the annular space; b) calculating a pressure profile of the annular space according to the amount of circulating flow and the depth of the surface level of cement slurry; c) determining a discharge capacity of the injection pump, so that a pressure at any depth in the pressure profile of the annular space is between a fracture pressure of formation and a pore pressure of formation; and d) controlling the injection pump to inject the fluid or the gas according to the determined discharge capacity.

Optionally, the steps a)-d) are executed, till that the surface level of cement slurry reaches to an external casing packer that is located in the annular space and on an upper part of a leaky zone.

Optionally, the external casing packer is opened to isolate the leaky zone, after the surface level of the cement slurry reaches to the external casing packer.

Optionally, a stage collar is utilized to make communication between a casing and the annular space above the external casing packer so that the cement slurry is injected into the annular space above the external casing packer, after the external casing packer isolates the leaky zone.

With the above-mentioned technical scheme, a return pipeline is utilized to lift the fluid in the annular space back to the platform, and the pressure of liquid column in the return pipeline is decreased by injecting a low-density fluid or gas into the return pipeline, and thereby the pressure acted on the leaky zones in the wellbore is decreased. After long-section leaky zones and multi-formation leaky-zones are packed up, the external casing packer separates the long-section leaky zones and the multi-formation leaky zones from the upper ordinary formation, and the well cementation is continued in the upper ordinary formation with a conventional well-cementing method, till that the entire well cementation task is accomplished. The technical scheme can effectively prevent the formation from fractured by high-density cement slurry and thereby avoid safety accidents such as well kick and well blowout, etc.

Other features and advantages of the present invention will be further detailed in the embodiments hereunder.

DESCRIPTION OF THE DRAWINGS

The accompanying drawings are provided here to facilitate further understanding on the present invention, and constitute a part of this document. They are used in conjunction with the following embodiments to explain the present invention, but shall not be comprehended as constituting any limitation to the present invention. Among the drawings.

Description of the Symbols

| | | | |
|---|---|---|---|
| 1a | Drilling rig | | |
| 1b | Drilling platform | 1c | Platform living area |
| 1d | Upper deck | 1e | Lower deck |
| 1f | Platform main body | 2 | Sea level |
| 3 | Sea bed | 4 | Marine riser |
| 5 | Drilling stem | 6 | Blowout preventer unit |
| 7 | Running head | 8 | Casing |
| 9 | Drilling fluid | 10 | Stage collar |
| 10a | Main body | 10b | Closing sleeve |
| 10c | Stage mechanism | 10d | Positioning key |
| 10e | Outer stage hole | 10f | Inner stage hole |
| 10g | Shear pin | 10h | Unlocking mechanism |
| 11 | External casing packer | 12 | Cement slurry |
| 13 | Annular space | 14 | Leaky zone |
| 15 | Retainer ring | 16 | Valve |
| 17 | Mass flowmeter | 18 | Check valve |
| 19 | Injection pipeline | 20 | Injection pump |
| 21 | Return pipeline | 22 | Bottom rubber plug |
| 23 | Gravity plug | 24 | Top rubber plug |

DETAILED DESCRIPTION OF THE EMBODIMENTS

Hereunder some embodiments of the present invention will be detailed with reference to the accompanying drawings. It should be appreciated that the embodiments described here are only provided to describe and explain the present invention, but shall not be deemed as constituting any limitation to the present invention.

To overcome the challenge from long-section leaky zones and multi-formation leaky zones in deep-water well drilling, the present invention provides a wellbore pressure control system, which utilizes a return pipeline to lift the fluid in an annular space in the wellbore back to the platform, while injecting a low-density fluid or gas into the return pipeline to decrease the pressure of liquid column in the return pipeline and thereby decrease the pressure acted on the leaky zones in the annular space of the wellbore. After long-section leaky zones and multi-formation leaky-zones are packed up, the external casing packer is opened to separate the long-section leaky zones and the multi-formation leaky zones from the upper ordinary formation, and well cementation is continued in the upper ordinary formation with a conventional well-cementing method, till that the entire well cementation task is accomplished.

Figure 1:
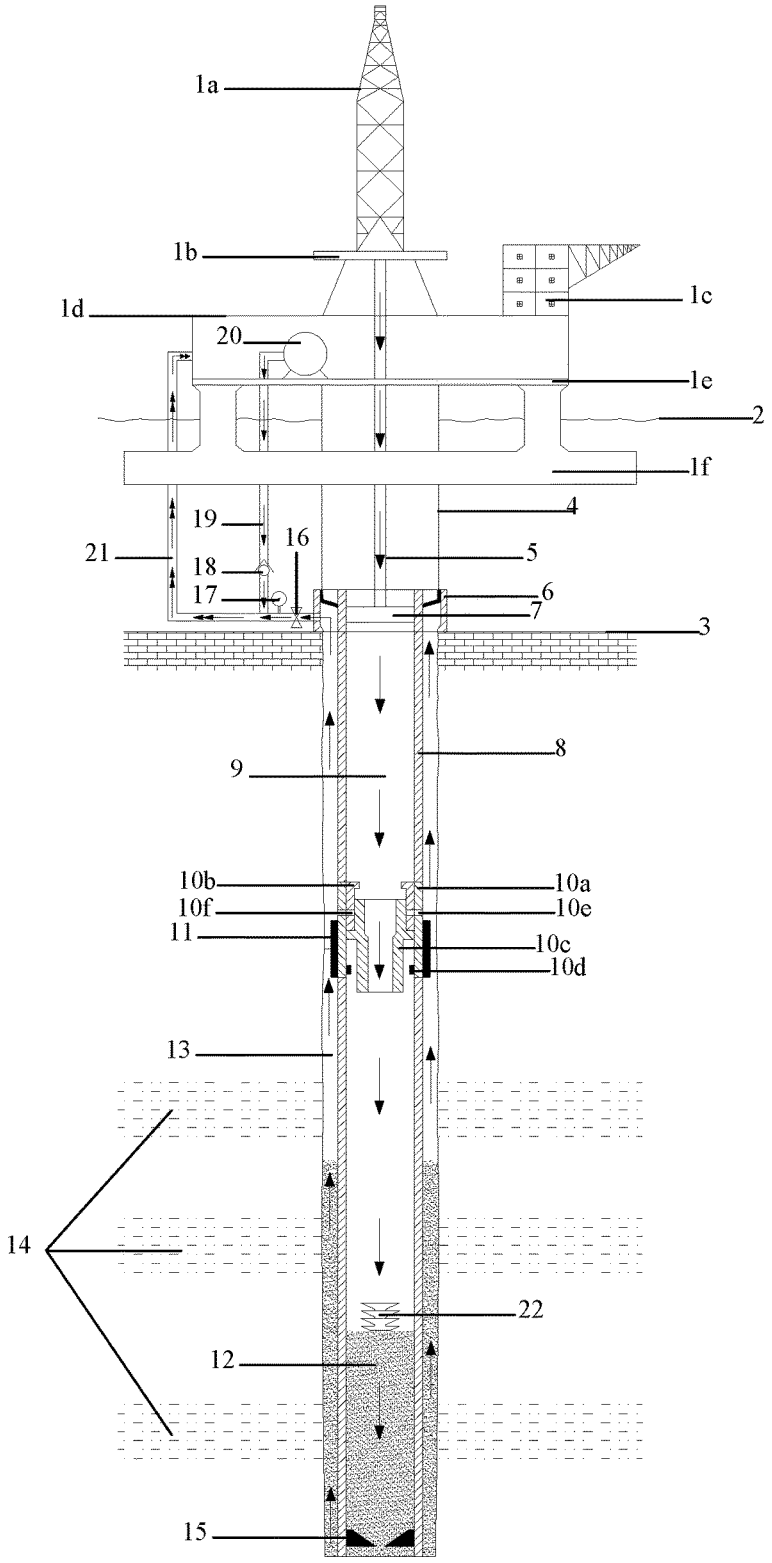
FIG. 1 is a schematic diagram of a first stage of well cementation operation with the wellbore pressure control system according to an embodiment of the present invention.

FIG. 1 is a schematic diagram of a first stage of well cementation operation with the wellbore pressure control system for well cementation stages according to an embodiment of the present invention. Firstly, the implementation environment and implementation process of the present invention will be described with reference to FIG. 1. To conduct offshore oil and gas mining, an offshore platform must be set up at first. The offshore platform comprises: a drilling rig 1*a*, a drilling platform 1*b*, a platform living area 1*c*, an upper deck 1*d*, a lower deck 1*e*, and a platform main body 1*f*. After the offshore platform is set up, the data such as the well structure of the current well, the fracture pressure of the formation in the well cementation section, and the pore pressure of the formation, etc., can be obtained according to the field well drilling and well testing information; as shown in FIG. 1, there are three leaky zones 14 in the well cementation section below the sea bed 3, and the leaky zones 14 have a characteristic of lower fracture pressure of the formation; therefore, if the leaky zones 14 are subject to a high pressure, safety accidents, such as well kick and well blowout, etc., may be incurred easily.

After the data, such as the well structure of the current well, the fracture pressure of the formation in the well cementation section, and the pore pressure of the formation, etc., has been obtained, the drilling stein 5 may be connected with a casing 8 (the casing 8 may be formed by a plurality of casing units connected in series) via a running head 7, a stage collar 10 and an external casing packer 11 may be mounted on the casing 8, and the casing 8 is run into the wellbore so that the stage collar 10 and the external casing packer 11 are located on the upper part of a leaky zone 14 (e.g., at 20*m* above). Next, the connected casing 8 is run into the wellbore, and a drilling fluid 9 is inputted cyclically to clean the rock debris in the wellbore.

Then, the annular space 13 between the casing 8 and the wellbore is closed by means of a blowout preventer unit 6, and a valve 16 is opened, so that the fluid in the annular space 13 will not return to the platform through a marine riser 4, but return to the platform through a return pipeline 21. A mass flowmeter 17 is arranged on the return pipeline 21 to monitor the flow of the return fluid in real time.

A sealing liquid, cement slurry 12, and a bottom rubber plug 22 are loaded into the wellbore, wherein, the sealing liquid is used to isolate the drilling fluid 9 and the cement slurry 12, and clean the well wall at the same time. The sealing liquid, cement slurry 12, and bottom rubber plug 22 will deposit from top to bottom, and the cement slurry 12 will enter into the annular space 13 at the bottom of the casing 8 under the pressure of the wellbore, and accumulate in the annular space 13 from bottom to top. The injection amount of the cement slurry 12 is determined with the following formula:

$$Q_1 = \frac{\pi}{4}(H - h_1)(d_w^2 - d_c^2)$$

Where, $Q_1$—amount of cement slurry injected for the first time, in unit of $m^3$; H—total well depth, in unit of m; $h_1$—depth of the stage collar, in unit of m; $d_w$—diameter of the wellbore, in unit of m; $d_c$—outer diameter of the casing, in unit of m. Relevant parameters mentioned here are marked in FIG. 6.

In the process that the cement slurry accumulates in the annular space from bottom to top, the leaky zones 14 where the cement slurry passes through may be fractured under such high pressure, because the density of the cement slurry 12 is very high, and the leaky zones 14 may suffer from very high pressure if the cement slurry on the upper part of the leaky zones 14 in the annular space reaches to certain height. To solve that problem, a return pipeline 21 is utilized in the present invention to lift the fluid (e.g., drilling fluid, sealing liquid, etc.) in the annular space in the wellbore back to the platform, and decreasing the pressure of liquid column in the return pipeline 21 by controlling an injection pump 20 to inject a low-density fluid or gas through an injection pipeline 19 into the return pipeline 21 at the same time, and thereby decrease the pressure acted on the leaky zones 14 in the annular space in the wellbore. A check valve 18 is mounted on the injection pipeline 19, so that the injection fluid can flow into the return pipeline 21 but the fluid in the return pipeline 21 can't flow back into the injection pipeline 19.

Figure 2:
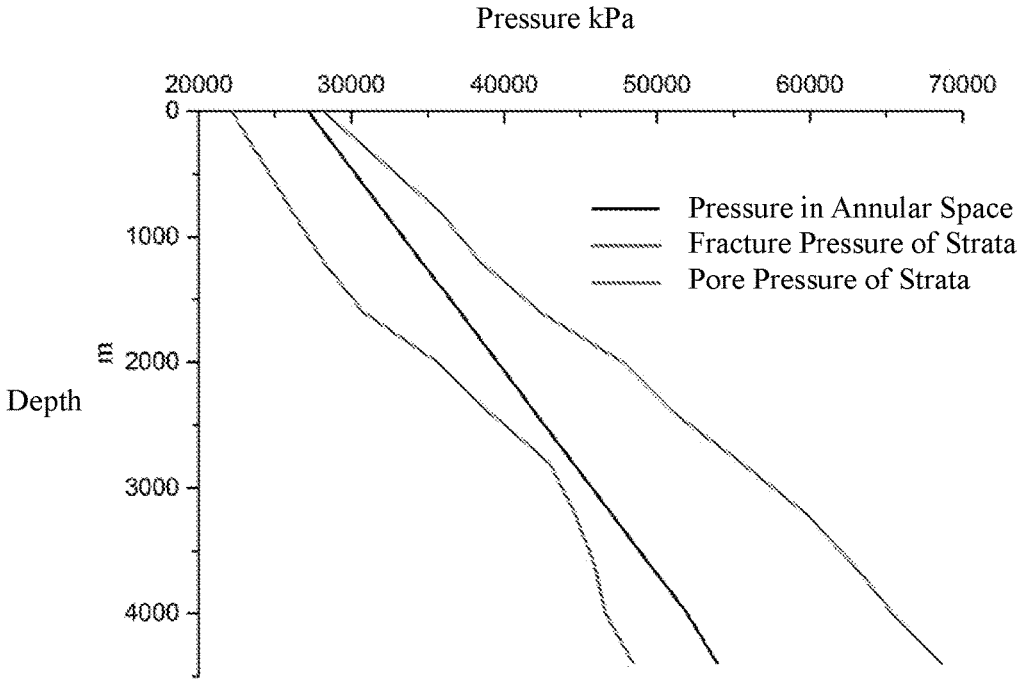
FIG. 2 is a schematic diagram of the pressure profile of the annular space.

The purpose of injecting a low-density fluid or gas into the return pipeline 21 is to decrease the pressure of liquid column in the return pipeline 21 and thereby prevent the formation from being fractured by the high-density cement slurry; however, if too much low-density fluid or gas is injected, the pressure in the wellbore will be lower than the pore pressure of the formation. Therefore, an appropriate injection amount must be determined, so that the pressure at any depth in the pressure profile of the annular space is between the fracture pressure of the formation and the pore pressure of the formation, as shown in FIG. 2. FIG. 2 shows three curves, which represent the pressure in the annular space, the fracture pressure of the formation, and the pore pressure of the formation respectively. If the pressure in the annular space is between the fracture pressure of the formation and the pore pressure of the formation, it means the pressure at any depth of the pressure profile of the annular space is between the fracture pressure of the formation and the pore pressure of the formation. An object of the present invention is to keep the pressure profile of the annular space in the state shown in FIG. 2.

Figure 3:
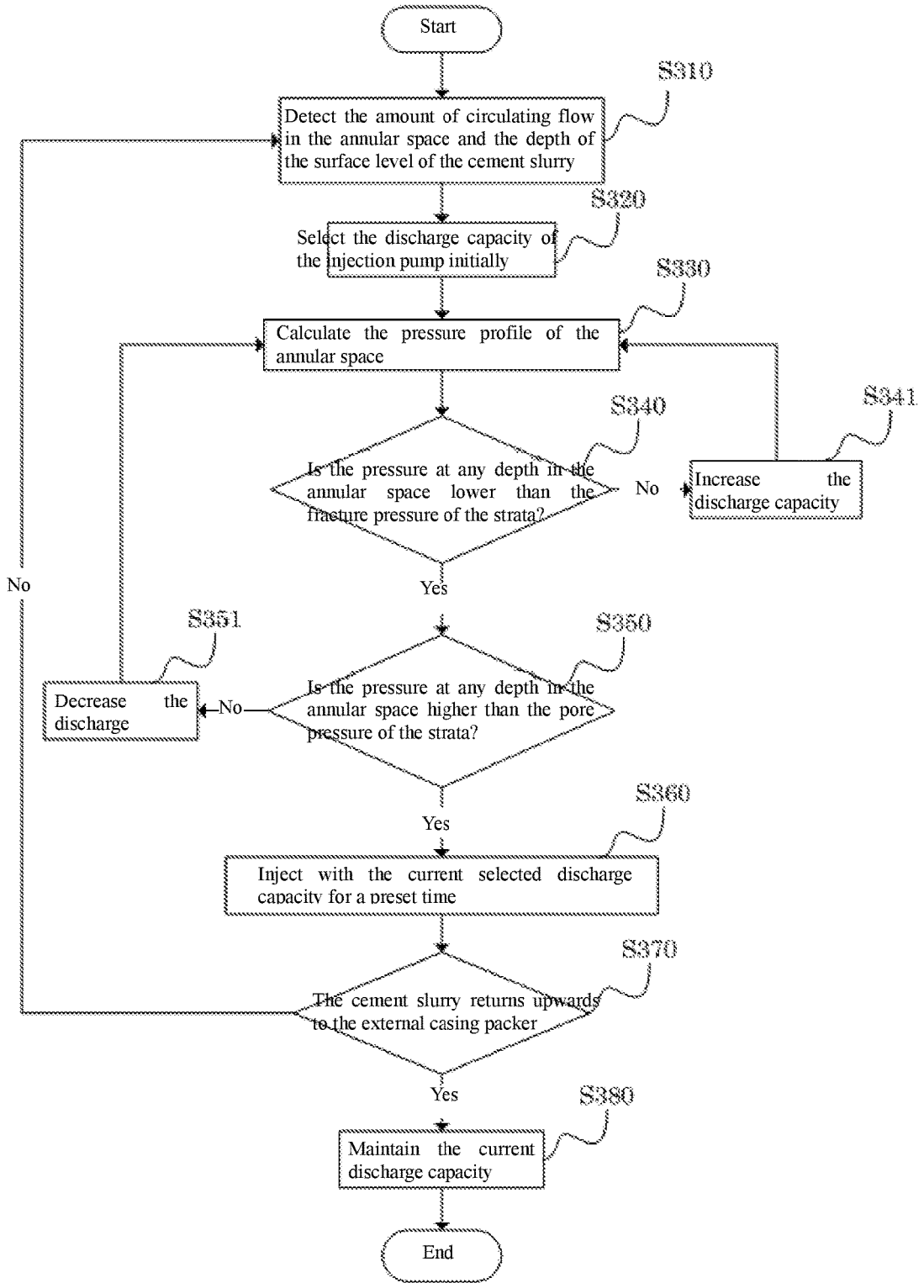
FIG. 3 is a flow chart of the method for determining the discharge capacity of the injection pump so as to keep the pressure profile of the annular space as the curve shown in FIG. 2.

FIG. 3 is a flow chart of the method for determining the discharge capacity of the injection pump so as to keep the pressure profile of the annular space as the curve shown in FIG. 2. As shown in FIG. 3, the control device in the wellbore pressure control system provided in an embodiment of the present invention can execute the following operations:

Step S310: acquiring the amount of circulating flow in the annular space and the depth of the surface level of cement slurry in the annular space. The amount of circulating flow may be read from the mass flowmeter 17, and the depth of the surface level of cement slurry in the annular space may be calculated from the cement slurry injection amount and the dimensions of the casing and the wellbore.

Step S320: selecting the initial discharge capacity of the injection pump. The initial discharge capacity is mainly used for subsequent adjustment for determining a final displacement. The initial discharge capacity can be any discharge capacity, for example, a discharge capacity equal to the reading on the mass flowmeter.

Step S330: calculating the pressure profile of the annular space according to the amount of circulating flow and the depth of the surface level of cement slurry. The pressure at well depth h is calculated as follows:

$$p = \bar{\rho} g h_{sea} + \frac{0.2 L v_{rl}^2 f_{rl} \bar{\rho}}{d_{rl}} + \rho_m g (h - h_{sea}) + \frac{2 f_m \rho_m (h - h_{sea}) v_m^2}{0.8165(d_w - d_c)} \quad (h < h_c)$$

$$p = \bar{\rho} g h_{sea} + \frac{0.2 L v_{rl}^2 f_{rl} \bar{\rho}}{d_{rl}} + p_m g (h_c - h_{sea}) +$$

-continued $$\frac{2f_m\rho_m(h_c-h_{sea})v_m^2}{0.8165(d_w-d_c)}+\rho_c g(h-h_c)+\frac{2f_c\rho_c(h-h_c)v_c^2}{0.8165(d_w-d_c)}\quad(h>h_c)$$

$$\text{where, } \bar{\rho}=\frac{q}{q+Q}\rho+\frac{Q}{q+Q}\rho_m,\ v_{rl}=\frac{4(q+Q)}{\pi d_{rl}^2},$$

$$v_m=\frac{4(q+Q)}{\pi(d_w^2-d_c^2)},\ v_c=\frac{4(q+Q)}{\pi(d_w^2-d_c^2)}$$

Where, $h_c$ is the depth of the surface level of cement slurry in the annular space, in unit of m; p is pressure, in unit of Pa; $\bar{\rho}$ is the density of the mixed fluid, which is mainly a mixture of drilling fluid, sealing liquid, and low-density fluid or gas because the wellbore is filled with drilling fluid before the sealing liquid and the cement slurry are injected, in unit of $kg/m^3$; ρ is the density of the injection fluid or gas, in unit of $kg/m^3$; $\rho_m$ is the density of the drilling fluid, in unit of $kg/m^3$; q is the injection amount of the low-density fluid or gas, in unit of $m^3$; Q is the real-time circulating flow amount in the wellbore, in unit of $m^3$; $h_{sea}$ is the sea water depth, in unit of m; g is the gravitational acceleration, in unit of $m/s^2$; L is the length of the return pipeline, in unit of m; $f_{rl}$ is the coefficient of fluid friction resistance in the return pipeline, dimensionless; $v_{rl}$ is the flow velocity of the fluid in the return pipeline, in unit of m/s; $d_{rl}$ is the inner diameter of the return pipeline, in unit of m; $f_m$ is the coefficient of friction resistance between the drilling fluid in the annular space and the well wall, dimensionless; $v_m$ is the flow velocity of the drilling fluid in the annular space, in unit of m/s; $\rho_c$ is the density of the cement slurry, in unit of $kg/m^3$; $f_c$ is the coefficient of friction resistance between the cement slurry in the annular space and the well wall, dimensionless; $v_c$ is the flow velocity of the cement slurry in the annular space, in unit of m/s.

Step S340: comparing the pressure profile of the annular space obtained from the calculation in the step S330 and the fracture pressure profile of the formation, and judging whether the pressure at any depth in the annular space is lower than the fracture pressure of the formation at the depth; if yes, executing the step S350 further; otherwise executing the step S341.

Step S341: increasing the discharge capacity of the injection pump, and going back to step S330 recalculating the pressure profile of the annular space.

Step S350: comparing the pressure profile of the annular space obtained from the calculation in the step S330 and the pore pressure profile of the formation, and judging whether the pressure at any depth in the annular space is higher than the pore pressure of the formation at the depth; if yes, executing the step S360 further; otherwise executing the step S351. Step S351: decreasing the discharging capacity of the injection pump, and going back to step and go back to step S330 recalculating the pressure profile of the annular space recalculating the pressure profile of the annular space.

Step S360: controlling the injection pump to inject the fluid or gas in the determined discharge capacity for a preset time (e.g., 1 minute), and then executing the step S370 further. The preset time can be set as small as possible, so that the discharge capacity of the injection pump can be adjusted more finely, and the probability that the pressure profile of the annular space is not between the pore pressure profile of the formation and the fracture pressure profile of the formation can be reduced. It should be noted that all steps before the step S360 are only early calculations for determining an appropriate displacement of the injection pump, and the injection pump is not controlled in actual in those steps to inject the fluid or gas.

Step S370: judging whether the cement slurry has returned upwards to the external casing packer; repeating the steps S310-S360 to adjust the injection amount further if the judgment result is negative; otherwise terminating the adjustment of the injection amount and executing the step S380.

Step S380: controlling the injection pump to maintain the current discharge capacity.

When the cement slurry 12 returns upwards into the annular space 13 and to the external casing packer 11 on the upper part of the leaky zone, and once the bottom rubber plug 22 moves to a retainer ring 15, the bottom of the casing 8 will be sealed and the cement slurry 12 in the annular space 13 will not return to the casing 8. At that point, the control device may open the external casing packer 11, to isolate the leaky zone. The drilling fluid input pump can be controlled to apply pressure (e.g., 1500 psi) into the casing, so as to open the external casing packer under a hydraulic action to isolate the leaky zone.

After the leaky zone 14 is isolated with the external casing packer 11, the stage collar 10 can be manipulated to make the casing 8 communicate with the annular space above the external casing packer so as to inject the cement slurry into the casing; after the cement slurry fall to the stage collar, it will be circulated upwards via the stage collar to the annular space above the casing and the external casing packer, and thereby cement injection into the annular space above the external casing packer is accomplished, without applying any pressure in the annular space below the external casing packer; thus, fracture of the leaky zone below the external casing packer owing to excessive pressure is avoided.

Figure 4A:
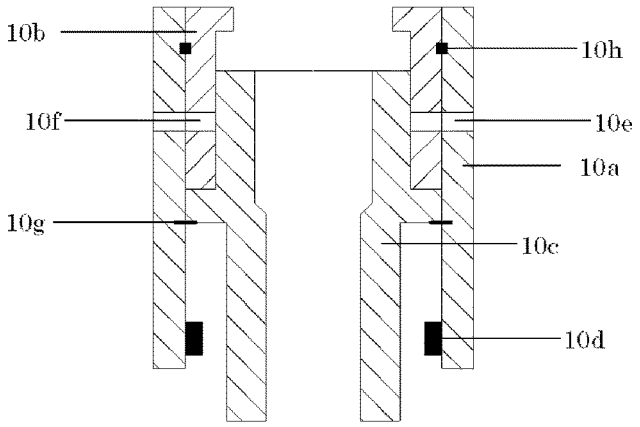
FIG. 4*a* is a schematic sectional view of the stage collar in a first state.
Figure 4B:
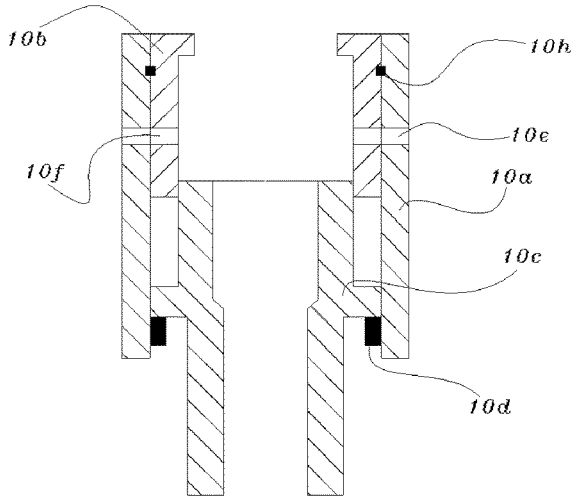
FIG. 4*b* is a schematic sectional view of the stage collar in a second state.
Figure 4C:
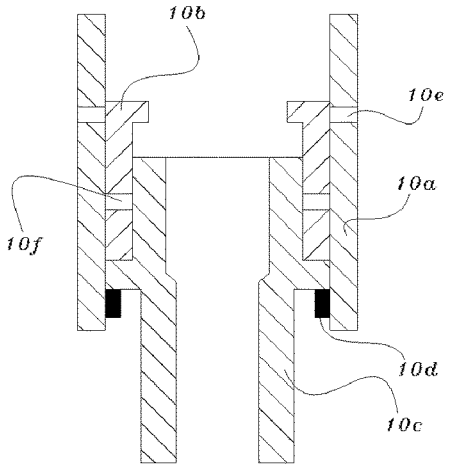
FIG. 4*c* is a schematic sectional view of the stage collar in a third state.

FIGS. 4*a*, 4*b* and 4*c* shows schematic sectional views of the stage collar in a first state, a second state, and a third state, respectively. As shown in FIGS. 4*a*-4*c*, the stage collar comprises: a main body 10*a*, with outer stage holes 10*e* on both sides respectively; a stage mechanism 10*c*; and a closing sleeve 10*b*, with inner stage holes 10*f* on both sides respectively, wherein, when the stage collar is in a first state, it is shielded by the stage mechanism 10*c*, and the outer stage holes 10*e* on both sides of the main body 10*a* and the inner stage holes 10*f* on both sides of the closing sleeve 10*b* don't communicate with each other; when the stage collar is in a second state, the stage mechanism 10*c* is displaced, so that the outer stage holes 10*e* on both sides of the main body 10*a* and the inner stage holes 10*f* on both sides of the closing sleeve 10*b* communicate with each other; when the stage collar is in a third state, the closing sleeve 10*b* is displaced, the outer stage holes 10*e* are staggered from the inner stage holes 10*f*, and the outer stage holes 10*e* on both sides of the main body 10*a* are shielded by the closing sleeve 10*b*.

Wherein, the stage collar further comprises: a shear pin 10*g*, via which the stage mechanism 10*c* is fixedly connected to the main body 10*a* when the stage collar is in the first state; and a positioning key 10*d*, located at the lower end of the main body 10*a*, wherein, after the shear pin 10*g* is sheared off, the stage mechanism 10*c* moves downwards, till that the lower end of the stage mechanism 10*c* is seated on the positioning key 10*d*. Moreover, the stage collar further comprises: an unlocking mechanism 10*h*, via which the main body 10*a* is fixedly connected to the closing sleeve 10*b* when the stage collar is in the first state or the second state, wherein, after the unlocking mechanism 10*h* is unlocked, the closing sleeve 10*b* moves downwards, till that the closing sleeve 10*b* is seated on the stage mechanism 10*c*, and, at this point, the stage collar is in the third state. By manipulating the shear pin 10*g* and the unlocking mechanism 10*h*, the stage collar can be switched among the first state, the second state, and the third state. Of course, the stage collar provided in the present invention is not limited to the composition of the shear pin and the unlocking mechanism; any other component that can implement a similar function is also applicable.

Figure 5:
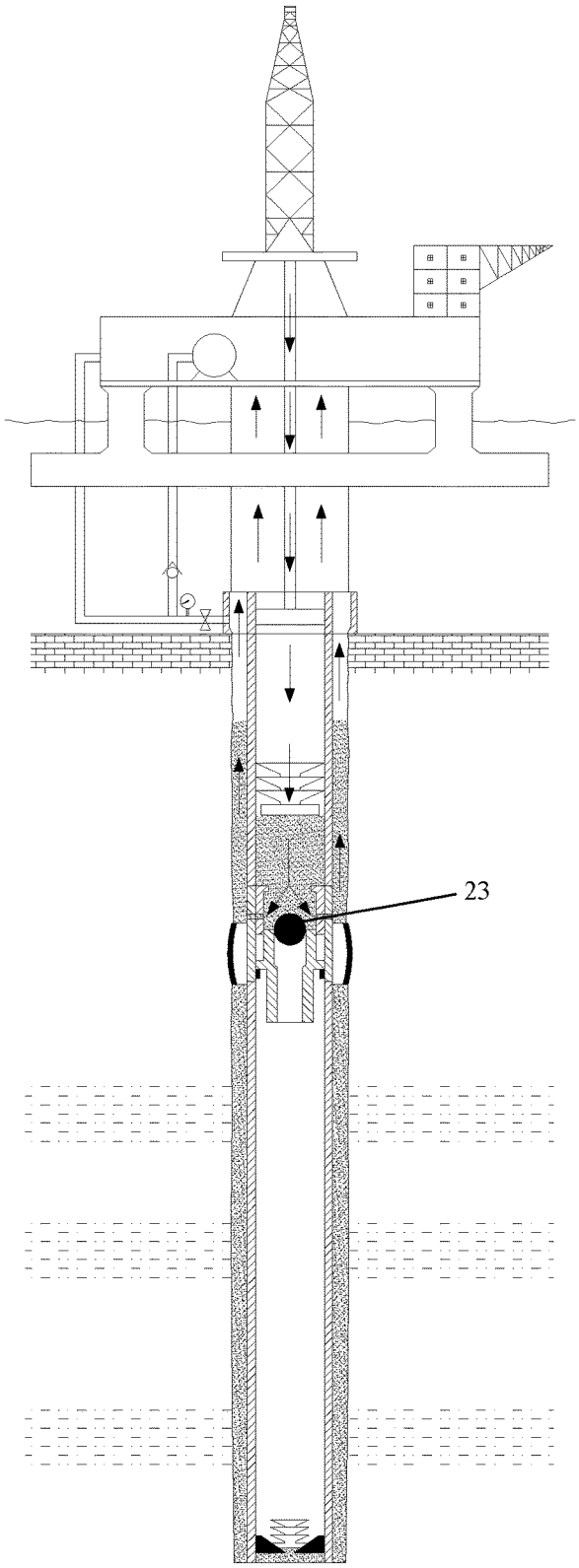
FIG. 5 is a schematic diagram of a second stage of well cementation operation with the wellbore pressure control system according to an embodiment of the present invention.
Figure 6:
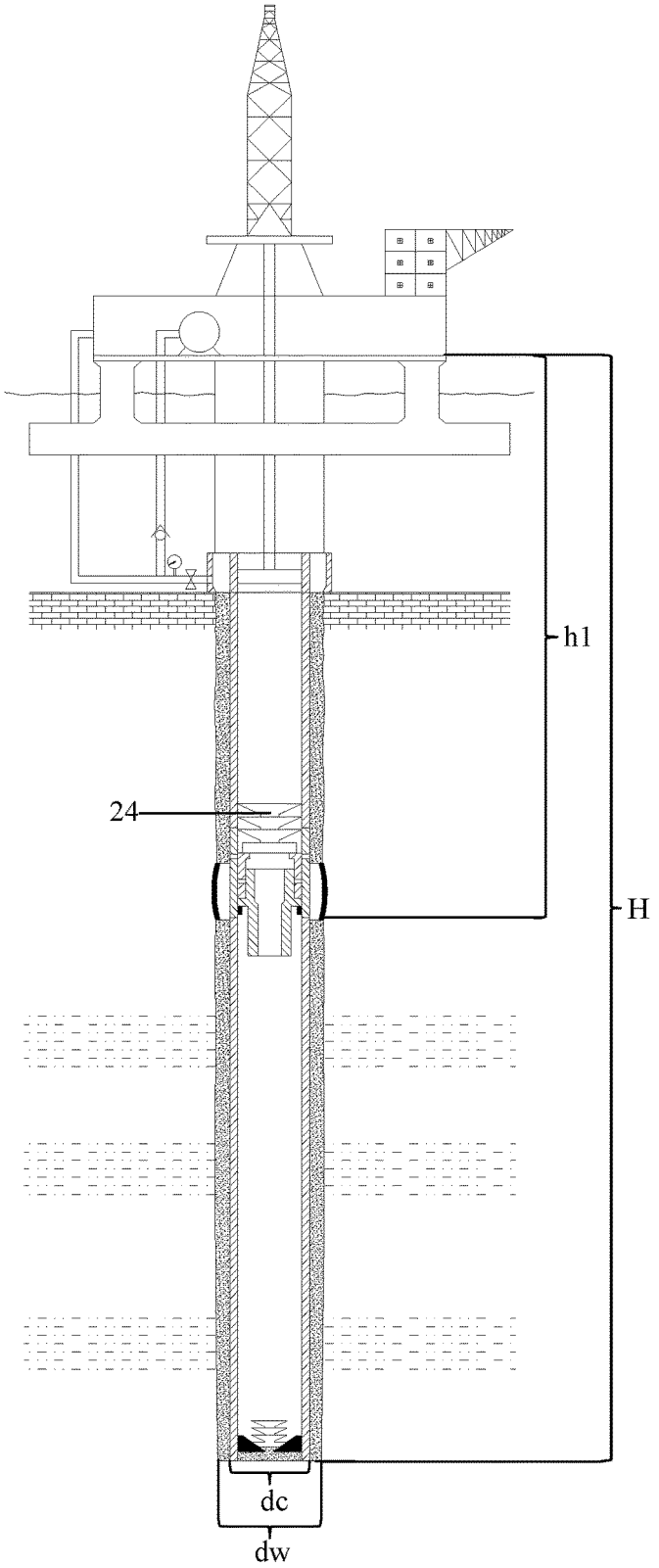
FIG. 6 is a schematic diagram of a completed well cementation operation with the wellbore pressure control system according to an embodiment of the present invention.

Hereunder the operation of the stage collar will be described with reference to the FIGS. 5 and 6. As shown in FIG. 5, after the leaky zone is isolated with the external casing packer, a gravity plug 23 can be loaded into the casing. The gravity plug 23 falls freely to the stage mechanism 10*c* of the stage collar, and the dimensions of the gravity plug 23 are slightly greater than those of the stage mechanism 10*c*; thus, the gravity plug 23 is obstructed at the stage mechanism 10*c*. Then, hydraulic pressure can be applied into the casing (e.g., by means of a drilling fluid injection pump). When the hydraulic pressure reaches a certain level, the shear pin 10*g* between the stage mechanism 10*c* and the main body 10*a* can be sheared off, and the stage mechanism 10*c* can be pushed downwards till that the bottom end of the stage mechanism is seated at the positioning key 10*d*. At that point, the outer stage holes 10*e* of the main body 10*c* and the inner stage holes 10*f* of the closing sleeve 10*b*, which communicate with each other, will be exposed, and thereby the casing will communicate with the annular space above the packer.

After the stage collar makes the casing communicate with the annular space above the packer, the annular space can be opened by manipulating a blowout preventer unit 6, and the valve 16 can be closed, so that the return fluid in the annular space will not return to the platform through the return pipeline, but will return to the platform through the marine riser 4. Then, sealing liquid, cement slurry, and top rubber plug 24 are loaded into the casing sequentially. The injection amount of the cement slurry is determined with the following formula, and is same as the volume of the annular space 13 from the stage collar to the sea bed:

$$Q_2 = \frac{\pi}{4}(h_1 - h_{sea})(d_w^2 - d_c^2)$$

Where, $Q_2$ is the amount of cement slurry injected for the second time, in unit of $m^3$.

The cement slurry is circulated, so that it enters into the annular space via the inner stage holes 10*f* and the outer stage holes of the stage collar and returns upwards (as shown in FIG. 5). When the top rubber plug 24 moves to the closing sleeve 10*b* (as shown in FIG. 6), the cement slurry will return upwards to the sea bed. At that point, pressure can be applied into the casing, so that the closing sleeve 10*b* and the main body 10*a* are unlocked under the hydraulic action, and the closing sleeve 10*b* moves downwards, till that the bottom part of the closing sleeve 10*b* is seated on the stage mechanism 10*c*. Now, the inner stage holes 10*f* of the closing sleeve 10 are staggered from the outer stage holes 10*e* of the main body 10*a*, and thereby the communication between the interior of the casing and the annular space is cut off. The well is kept still for some time, to wait for the cement slurry to cure. Then, the well cementation is finished.

The technical scheme of the present invention is described above with reference to an entire cementing process. FIGS. 1 and 5 show two stages of well cementation. Specifically, FIG. 1 shows a stage of cement slurry injection into an annular space of a leaky zone, i.e., the first stage. In that stage, the injection amount of the low-density fluid or gas must be adjusted accurately, to ensure the pressure profile of the annular space is between the fracture pressure profile of the formation and the pore pressure profile of the formation, and thereby avoid fracture of the leaky zone. FIG. 5 shows a stage of opening the external casing packer and injecting the cement slurry into the annular space above the external casing packer after the surface level of the cement slurry in the annular space reaches to the external casing packer located on the upper part of the leaky zone, i.e., the second stage. FIG. 6 is a schematic diagram illustrating the situation when the second stage is finished. At that time, the surface level of the cement slurry has reached to the sea bed. The technical scheme of the present invention can prevent the leaky zone from being fractured in the well cementation process and thereby avoid safety accidents, such as well kick and well blowout, etc.

While some preferred embodiments of the present invention are described above with reference to the accompanying drawings, the present invention is not limited to the details in those embodiments. Those skilled in the art can make modifications and variations to the technical scheme of the present invention, without departing from the spirit of the present invention. However, all these modifications and variations shall be deemed as falling into the protected scope of the present invention.

In addition, it should be appreciated that the technical features described in the above embodiments can be combined in any appropriate manner, provided that there is no conflict among the technical features in the combination. To avoid unnecessary iteration, such possible combinations are not described here in the present invention.

Those skilled in the art can appreciate that all or a part of the steps constituting the method in the above-mentioned embodiment can be implemented by instructing relevant hardware with a program, which is stored in a storage medium and includes several instructions to instruct a single-chip microcomputer, a chipset, or a processor to execute all or a part of the steps of the methods in the embodiments of the present application. The storage medium comprises: U-disk, removable hard disk, Read-Only Memory (ROM), Random Access Memory (RAM), diskette, or CD-ROM, or a similar medium that can store program codes.

Moreover, different embodiments of the present invention can be combined freely as required, as long as the combinations don't deviate from the ideal and spirit of the present invention. However, such combinations shall also be deemed as falling into the scope disclosed in the present invention.

What is claimed is:

1. A wellbore pressure control system for well cementation stages, comprising:

an injection pump; and a control device, configured to control the injection pump to inject a fluid or a gas through an injection pipeline to a return pipeline that communicates with an annular space in a wellbore to decrease a pressure in the return pipeline and thereby decrease the pressure in the annular space, wherein, a density of the fluid or the gas is lower than a density of a drilling fluid in the annular space;

wherein the control device is further configured to execute the following operations:

a) acquiring an amount of circulating flow in the annular space and a depth of the surface level of cement slurry in the annular space;

b) calculating a pressure profile of the annular space according to the amount of circulating flow and the depth of the surface level of cement slurry;

c) determining a discharge capacity of the injection pump, so that a pressure at any depth in the pressure profile of the annular space is between a fracture pressure of formation and a pore pressure of formation; and d) controlling the injection pump to inject the fluid or the gas according to the determined discharge capacity; and wherein a pressure at a well depth h from the pressure profile of the annular space is calculated as follows:

$$p = \bar{\rho} g h_{sea} + \frac{0.2 L v_{rl}^2 f_{rl} \bar{\rho}}{d_{rl}} + \rho_m g (h - h_{sea}) + \frac{2 f_m \rho_m (h - h_{sea}) v_m^2}{0.8165 (d_w - d_c)} \quad (h < h_c)$$

$$p = \bar{\rho} g h_{sea} + \frac{0.2 L v_{rl}^2 f_{rl} \bar{\rho}}{d_{rl}} + p_m g (h_c - h_{sea}) + \frac{2 f_m \rho_m (h_c - h_{sea}) v_m^2}{0.8165 (d_w - d_c)} + \rho_c g (h - h_c) + \frac{2 f_c \rho_c (h - h_c) v_c^2}{0.8165 (d_w - d_c)} \quad (h > h_c)$$

where, $$\bar{\rho} = \frac{q}{q+Q} \rho + \frac{Q}{q+Q} \rho_m, \; v_{rl} = \frac{4(q+Q)}{\pi d_{rl}^2},$$

$$v_m = \frac{4(q+Q)}{\pi (d_w^2 - d_c^2)}, \; v_c = \frac{4(q+Q)}{\pi (d_w^2 - d_c^2)}$$

where, $h_c$ is the depth of the surface level of cement slurry in the annular space, in unit of m; p is pressure, in unit of Pa; $\bar{\rho}$ is the density of the mixed fluid, which is mainly a mixture of drilling fluid, sealing liquid, and low-density fluid or gas because the wellbore is filled with drilling fluid before the sealing liquid and the cement slurry are injected, in unit of kg/m$^3$; ρ is the density of the injection fluid or gas, in unit of kg/m$^3$; $\rho_m$ is the density of the drilling fluid, in unit of kg/m$^3$; q is the injection amount of the low-density fluid or gas, in unit of m$^3$; Q is the real-time circulating flow amount in the wellbore, in unit of m$^3$; $h_{sea}$ is the sea water depth, in unit of m; g is the gravitational acceleration, in unit of m/s$^2$; L is the length of the return pipeline, in unit of m; $f_{rl}$ is the coefficient of fluid friction resistance in the return pipeline, dimensionless; $v_{rl}$ is the flow velocity of the fluid in the return pipeline, in unit of m/s; $d_{rl}$ is the inner diameter of the return pipeline, in unit of m; $f_m$ is the coefficient of friction resistance between the drilling fluid in the annular space and the well wall, dimensionless; $v_m$ is the flow velocity of the drilling fluid in the annular space, in unit of m/s; $\rho_{cv}$ is the density of the cement slurry, in unit of kg/m$^3$; $f_c$ is the coefficient of friction resistance between the cement slurry in the annular space and the well wall, dimensionless; $v_c$ is the flow velocity of the cement slurry in the annular space, in unit of m/s.

2. The wellbore pressure control system according to claim 1, wherein, the control device executes the steps a)-d) repeatedly, till that the surface level of cement slurry reaches to an external casing packer that is located in the annular space and on an upper part of a leaky zone.

3. The wellbore pressure control system according to claim 2, wherein, the control device is further configured to open the external casing packer to isolate the leaky zone, after the surface level of cement slurry reaches to the external casing packer.

4. The wellbore pressure control system according to claim 3, further comprising a stage collar configured to make communication between a casing and the annular space above the external casing packer so that the cement slurry is injected into the annular space above the external casing packer, after the external casing packer isolates the leaky zone.

5. The wellbore pressure control system according to claim 4, wherein, the stage collar comprises:

a main body, with outer stage holes on both sides respectively;

a stage mechanism; and a closing sleeve, with inner stage holes on both sides respectively; wherein, when the stage collar is in a first state, the stage collar is shielded by the stage mechanism, so that the outer stage holes on both sides of the main body and the inner stage holes on both sides of the closing sleeve do not communicate with each other;

when the stage collar is in a second state, the stage mechanism is displaced, so that the outer stage holes on both sides of the main body and the inner stage holes on both sides of the closing sleeve communicate with each other;

when the stage collar is in a third state, the closing sleeve is displaced, the outer stage holes are staggered from the inner stage holes, and the outer stage holes on both sides of the main body are shielded by the closing sleeve.

6. The wellbore pressure control system according to claim 5, wherein, the stage collar further comprises:

a shear pin, via which the stage mechanism is fixedly connected to the main body when the stage collar is in the first state; and a positioning key, located at the lower end of the main body, wherein, after the shear pin is sheared off, the stage mechanism moves downwards, till that a lower end of the stage mechanism is seated on the positioning key.

7. The wellbore pressure control system according to claim 5, wherein, the stage collar further comprises:

an unlocking mechanism, via which the main body is fixedly connected to the closing sleeve when the stage collar is in the first state or the second state, wherein, after the unlocking mechanism is unlocked, the closing sleeve moves downwards, till that the closing sleeve is seated on the stage mechanism, and, at this point, the stage collar is in the third state.

8. A wellbore pressure control method for well cementation stages, comprising the following procedure:

controlling an injection pump to inject a fluid or a gas through an injection pipeline to a return pipeline that communicates with an annular space in a wellbore to decrease a pressure in the return pipeline and thereby decrease a pressure in the annular space, wherein, a density of the fluid or the gas is lower than a density of a drilling fluid in the annular space;

wherein the step of controlling the injection pump to inject the fluid or the gas via the injection pipeline into the return pipeline that communicates with the annular space in the wellbore comprises the following steps:

a) acquiring an amount of circulating flow in the annular space and a depth of the surface level of cement slurry in the annular space;

b) calculating a pressure profile of the annular space according to the amount of circulating flow and the depth of the surface level of cement slurry;

c) determining a discharge capacity of the injection pump, so that a pressure at any depth in the pressure profile of the annular space is between a fracture pressure of formation and a pore pressure of formation; and d) controlling the injection pump to inject the fluid or the gas according to the determined discharge capacity; and wherein a pressure at a well depth h from the pressure profile of the annular space is calculated as follows:

$$p = \overline{\rho} g h_{sea} + \frac{0.2 L v_{rl}^2 f_{rl} \overline{\rho}}{d_{rl}} + \rho_m g (h - h_{sea}) + \frac{2 f_m \rho_m (h - h_{sea}) v_m^2}{0.8165 (d_w - d_c)} \quad (h < h_c)$$

$$p = \overline{\rho} g h_{sea} + \frac{0.2 L v_{rl}^2 f_{rl} \overline{\rho}}{d_{rl}} + p_m g (h_c - h_{sea}) + \frac{2 f_m \rho_m (h_c - h_{sea}) v_m^2}{0.8165 (d_w - d_c)} + \rho_c g (h - h_c) + \frac{2 f_c \rho_c (h - h_c) v_c^2}{0.8165 (d_w - d_c)} (h > h_c)$$

where, $$\overline{\rho} = \frac{q}{q+Q} \rho + \frac{Q}{q+Q} \rho_m, \; v_{rl} = \frac{4(q+Q)}{\pi d_{rl}^2},$$

$$v_m = \frac{4(q+Q)}{\pi (d_w^2 - d_c^2)}, \; v_c = \frac{4(q+Q)}{\pi (d_w^2 - d_c^2)}$$

where, $h_c$ is the depth of the surface level of cement slurry in the annular space, in unit of m; p is pressure, in unit of Pa; $\overline{\rho}$ is the density of the mixed fluid, which is mainly a mixture of drilling fluid, sealing liquid, and low-density fluid or gas because the wellbore is filled with drilling fluid before the sealing liquid and the cement slurry are injected, in unit of kg/m$^3$; ρ is the density of the injection fluid or gas, in unit of kg/m$^3$; $\rho_m$ is the density of the drilling fluid, in unit of kg/m$^3$; q is the injection amount of the low-density fluid or gas, in unit of m$^3$; Q is the real-time circulating flow amount in the wellbore, in unit of m$^3$; $h_{sea}$ is the sea water depth, in unit of m; g is the gravitational acceleration, in unit of m/s$^2$; L is the length of the return pipeline, in unit of m; $f_{rl}$ is the coefficient of fluid friction resistance in the return pipeline, dimensionless; $v_{rl}$ is the flow velocity of the fluid in the return pipeline, in unit of m/s; $d_{rl}$ is the inner diameter of the return pipeline, in unit of m; $f_m$ is the coefficient of friction resistance between the drilling fluid in the annular space and the well wall, dimensionless; $v_m$ is the flow velocity of the drilling fluid in the annular space, in unit of m/s; $\rho_c$ is the density of the cement slurry, in unit of kg/m$^3$; $f_c$ is the coefficient of friction resistance between the cement slurry in the annular space and the well wall, dimensionless; $v_c$ is the flow velocity of the cement slurry in the annular space, in unit of m/s.

9. The wellbore pressure control method according to claim 8, wherein, the steps a)-d) are executed, till that the surface level of cement slurry reaches to an external casing packer that is located in the annular space and on an upper part of a leaky zone.

10. The wellbore pressure control method according to claim 9, wherein, the external casing packer is opened to isolate the leaky zone, after the surface level of cement slurry reaches to the external casing packer.

11. The wellbore pressure control method according to claim 10, wherein, a stage collar is utilized to make communication between a casing and the annular space above the external casing packer so that the cement slurry is injected into the annular space above the external casing packer, after the external casing packer isolates the leaky zone.

* * * * *